United States Patent [19]

Sugiyama et al.

[11] Patent Number: 4,590,712

[45] Date of Patent: May 27, 1986

[54] VERTICAL SPINDLE DUPLEX HEAD FOR A GRINDER

[75] Inventors: Yasuo Sugiyama; Masaomi So, both of Osaka; Ichiro Hamaguchi, Nara; Kenichi Maeda, Osaka, all of Japan

[73] Assignees: Koyo Seike Company Limited; Koyo Machine Industries Company, both of Osaka, Japan

[21] Appl. No.: 785,082

[22] Filed: Oct. 4, 1985

Related U.S. Application Data

[63] Continuation of Ser. No. 574,961, Jan. 30, 1984, abandoned.

[30] Foreign Application Priority Data

Jun. 8, 1983 [JP] Japan ..... 58-102249

[51] Int. Cl.[4] ..... B24B 5/00

[52] U.S. Cl. ..... 51/161; 51/73 R; 51/108 R; 74/675

[58] Field of Search ..... 51/73 R, 103 R, 103 WH, 51/161, 237 R, 237 M, 289 R, 108 R, 134, 134.5, 117–119; 74/675

[56] References Cited

U.S. PATENT DOCUMENTS

| | | | |
|---|---|---|---|
| 1,447,263 | 3/1923 | Norton | 51/108 R X |
| 2,275,061 | 3/1942 | Indge | 51/117 |
| 2,422,343 | 6/1947 | Duer | 74/675 |
| 2,586,953 | 2/1952 | Johnson | 51/73 R |
| 2,940,337 | 6/1960 | Kalb | 74/675 |

FOREIGN PATENT DOCUMENTS 1652055 2/1973 Fed. Rep. of Germany .

*Primary Examiner*—Frederick R. Schmidt
*Assistant Examiner*—Debra S. Meislin
*Attorney, Agent, or Firm*—Mason, Fenwick & Lawrence

[57] ABSTRACT

A vertical spindle duplex head for a grinder includes an annular pressure wheel and a receiver wheel arranged to rotate and revolve workpieces between the annular surfaces of the pressure wheel and the receiver wheel and a grindstone for one end portion of the workpieces driven in the opposite directions of rotation of the pressure wheel and receiver wheel and at their different rotational ratios. The workpieces rotate and revolve between these wheels, thereby grinding their end face by means of a grindstone arranged around the external periphery of a rotary carrier.

The pressure wheel and receiver wheel are rotatably driven in opposite directions and at their different rotational speeds by distributing driving force from one source to each of them and a variable driving means is provided on one of the transmittance routes of the driving force extending from the place of distributing the driving force to both of the pressure wheel and the receiver wheel, whereby the rotational ratio of each of them can be optionally changed.

1 Claim, 8 Drawing Figures

VERTICAL SPINDLE DUPLEX HEAD FOR A GRINDER

This application is a continuation, of application Ser. No. 574,961, filed Jan. 30, 1984, now abandoned.

BACKGROUND OF THE INVENTION

The present invention relates to a vertical spindle duplex head for a grinder and its grinding method for grinding the end face of workpieces to be shaped into a spherical surface, while rotating and revolving the workpieces.

The vertical spindle duplex head grinder which has the receiving wheel and the pressure wheel driven by their individual driving device is well-known. In that case, since two driving devices are provided, two general-purpose motors are used as the driving sources thereof. Nevertheless, the difference in efficiency between these two general-purpose motors and the slipping and instability of the motors' rotation due to grinding resistance makes it extremely difficult to maintain accurately the ratio between their rotational speeds, resulting in the problem of facing a difficulty in establishing a constant grinding condition.

INFORMATION DISCLOSURE

A. West German Pat. No. 1652055, Feb. 22, 1973: Hahn & Kolb

The duplex head for a grinder according to this disclosure, as shown in FIG. 1, transmits the output of a motor M through a chain or a timing driving belt K, a clutch D, and the chain or the timing driving belt E, a gear device F, etc. to a driving shaft G of a lower grinding wheel A. At the same time, said output is transmitted by way of a gear device H having a different speed ratio to a driving shaft J of a rotary carrier C and, furthermore, through the chain or the timing driving belts K & L to a driving shaft N of an upper grinding wheel B. P is a working mechanism for advancing/retreating the upper grinding wheel B to/from the lower grinding wheel A. W is a workpiece.

Since such a conventional device fixes each of the rotational ratios of both the grinding wheels, and the rotary carrier to the motor, in spite of making a change in the motor's rotational frequency, the rotating and revolving speeds of the workpiece only become slow or fast correspondingly to the above-mentioned change. For this reason, in case of performing the grinding process of the end face of the workpiece, for example, by means of the grindstone arranged around the periphery of the rotary carrier, the number of rotations taking place by the time of the finish of grinding the workpieces is constant with respect to the length of the grindstone (the circumferential length of the rotary carrier), being quite unchanged. That causes the disadvantage of the inability to perform the grinding process according to the required dimension of the margin to be ground on the end face of the workpiece and the required degree of finishing. If the rotational ratios of the upper and lower grinding wheels, and the rotary carrier to the motor are desired to be changed, it is needed to replace the gears and the wheels of the chain or the timing belt, etc., the replacing work becoming complex so that a marked number of processes cannot be avoided.

SUMMARY OF THE INVENTION

The first object of the present invention is to eliminate the imperfections of a vertical spindle duplex head for a grinder, more particularly, all the defects of the conventional device in driving an upper pressure wheel and a lower receiver wheel. Another object of the present invention is to provide a device capable of optionally changing the number of rotations of the workpiece corresponding to the length of the grindstone arranged around the external periphery of the rotary carrier, moreover making such a changing operation easier, and performing the grinding process according to the margin to be ground of the workpiece and the desired degree of finishing.

The present invention is characterized in that the vertical spindle duplex head for a grinder is provided with a pressure wheel and a receiver wheel to be rotated in directions opposite to each other and at their different rotational speeds by distributing the driving force from one source, and a variable driving means on one of the transmittance routes of the driving force to the pressure wheel and the receiver wheel, thereby making it possible to change optionally the rotational ratio between the pressure wheel and the receiver wheel which are driven to be rotated.

DESCRIPTION OF THE PREFERRED EMBODIMENT

Figure 2:
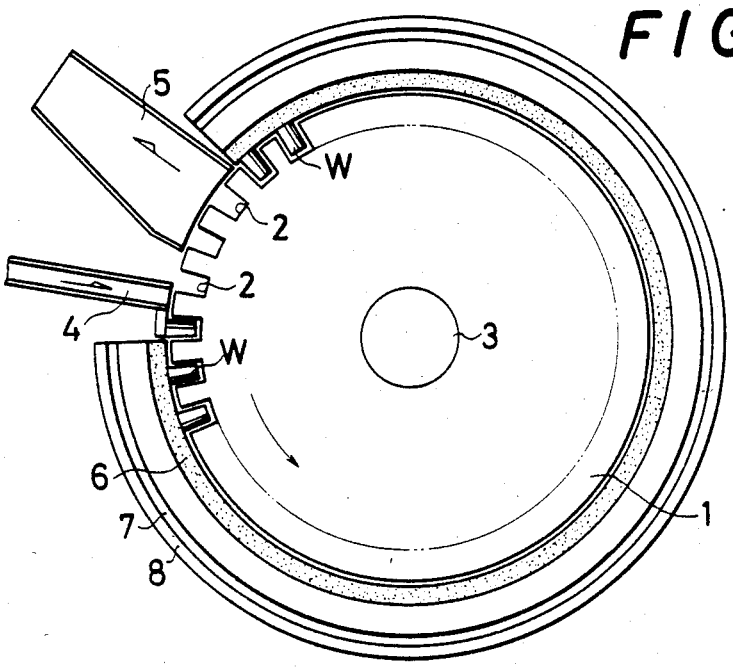
FIG. 2 is a plan view of the rotary carrier.

The description of the present invention is made in conjunction with FIGS. 2–6 illustrating the embodiment thereof in detail; the rotary carrier 1, as shown in FIG. 2, houses the workpiece W to be rolled such as the roller in a pocket 2 provided on the periphery thereof, being rotated around a shaft 3 in a direction indicated by an arrow. Its rotational speed, as referred to hereinafter, is determined by the difference between the rotational speed of a pressure wheel and that of a receiver wheel. There are provided a chute 4 for supplying the workpieces W to the rotary carrier 1, and a chute 5 for exhausting the workpieces out of the rotary carrier 1.

An annular grindstone 6 is provided at the external periphery of the rotary carrier 1 and is firmly held by a holding member 7. In that case, the structure and shape of the grindstone are not limited to the illustrated example, and the length thereof (the length of the circumferential direction for the illustrative example) may be also modified adequately.

Figure 3:
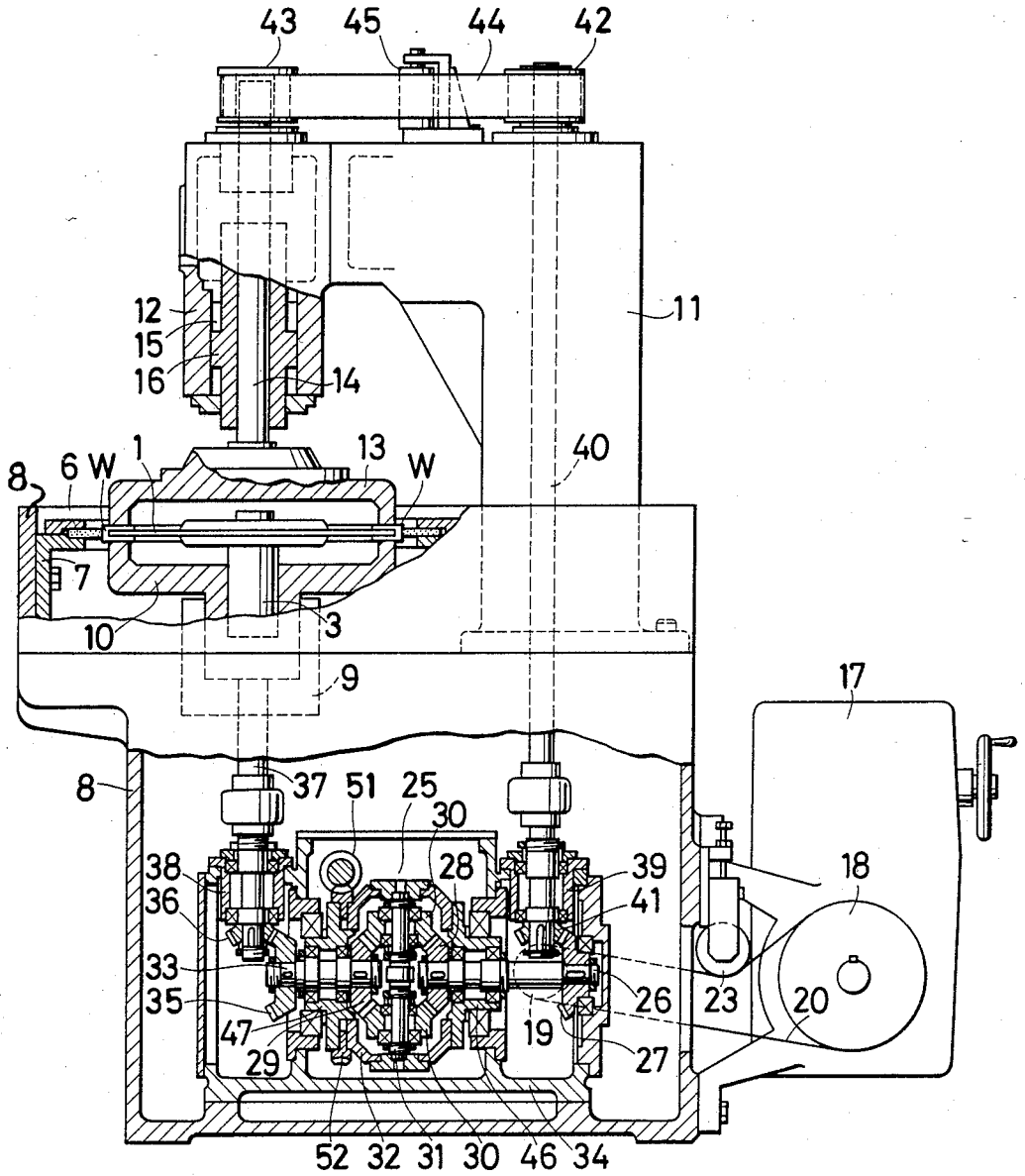
FIG. 3 is a partially cut-away view of the embodiment according to the present invention.
Figure 4:
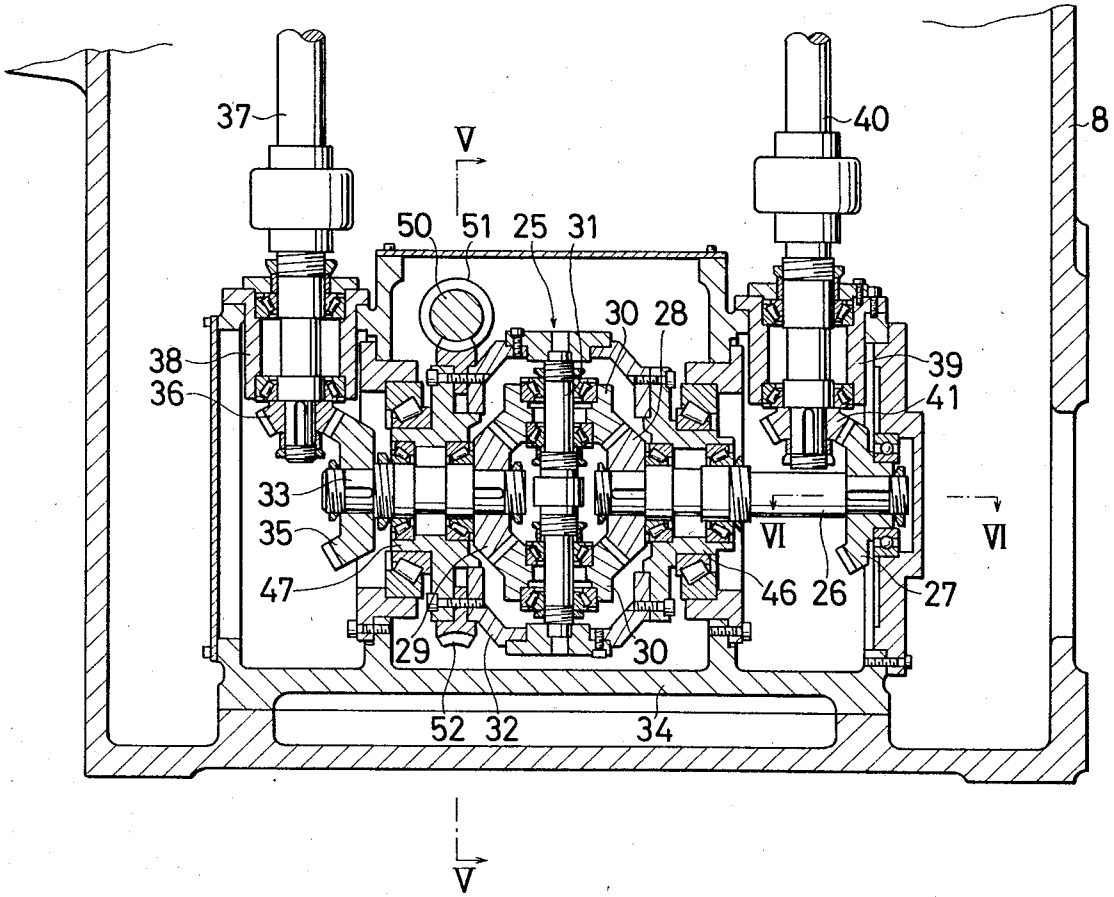
FIG. 4 is an enlarged sectional view of the principal part.

As shown in FIG. 3, the annular receiver wheel 10, supported rotatably on the bearing housing 9 of the frame 8, is arranged on the lower face of the rotary carrier 1. The annular pressure wheel 13, supported on a pressure head 12 provided on the top end of the column 11 in rotatable as well as vertically shiftable manners, is arranged over the receiver wheel 10. The pressure head 12 has a pressure cylinder 15 through which a spindle 14 of the pressure wheel 13 passes longitudinally, and a pressure piston 16 in the cylinder 15 is in mesh with said spindle 14 so that the pressure piston 16 may be at least vertically moved, while being united with the spindle 14. At the time of grinding the pressure wheel 13 is moved downward by supplying fluid pressure such as hydraulic pressure cylinder 15 and the workpiece W held by the rotary carrier 1 is pressed between the pressure wheel 13 and the receiver wheel 10. When the rotary carrier 1 is replaced, the pressure wheel 13 is moved upward.

A reduction gear 17 possessing a speed changing means equipped with such a driving source as a driving motor, etc. (not shown), which is mounted on the side of the frame 8, drives the shaft 22 supported by the bearing housing 21 of the frame 8 by way of pulleys 18 and 19 and a timing belt 20. (See FIGS. 3 and 6.) There is provided a tension pulley 23 for adjusting the tension force of the timing belt 20. The shaft 22 engages a bevel gear 24 mounted on the end of the shaft 22 with the bevel gear 27 mounted on an input shaft 26 in a differential gear mechanism 25 provided in the frame 8.

The differential gear mechanism 25 includes a pair of sun gears 28 and 29, generally two planet gears 30 in mesh with both the sun gears at the same time, and a revolving gear case 32 which is rotatably supported by a gear box 34 in the frame 8, supports the planet gear shaft 31, and is rotated at the same speed by the revolution of the planet gear 30. The sun gear 28 at the input side is mounted on the above-mentioned input shaft 26, whereas the sun gear 29 at the output side is mounted on the output shaft 33 rotatably supported by the revolving gear case 32.

The gear 35 of output shaft 33 in the differential gear 36 mechanism 25 is adapted to be in mesh with the gear of driving shaft 37 on the receiver wheel 10 and rotating said driving shaft 37 with its constant rotational ratio to the output shaft 33 leads to the drive of the receiver wheel 10. The driving shaft 37 on the receiver wheel 10 is pivotally mounted on the bearing housing 38 in the gear box 34.

The gear 41, pivotally mounted on the bearing housing 39 in the gear box 34, which is located at the lower end of the driving shaft 40 of pressure wheel 13, through which the column 11 longitudinally passes, is adapted to be in mesh with the gear 27 of input shaft 26 in the differential gear mechanism 25 and the driving shaft 40 of the pressure wheel is rotated with its constant rotational ratio to the input shaft 26. The driving shaft 40 of the pressure wheel and the rotating shaft 14 of pressure wheel are interlocked to be rotated by a tension belt 44 adjusted by a tension pulley 45 between pulleys 42 and 43, resulting in the driving of the pressure wheel 13. The pulley 43 is rotated in the rotational direction of the rotational shaft of the pressure wheel, while being united with said rotational shaft 14 and is adapted not to be vertically moved together with the vertical movement of the rotational shaft 14 by an adequate means such as a key and key slot or other means.

Since the input shaft 26 and the output shaft 33 in the differential mechanism 25 are, as known well, rotated in their directions opposite to each other, judging from the foregoing description, the receiver wheel 10 and the pressure wheel 13 are also rotated in their directions opposite to each other. On the other hand, the rotary carrier 1 is freely rotatably supported by its shaft 3 in a boss of the receiver wheel 10. As mentioned above, since the receiver wheel 10 and the pressure wheel 13 are rotated in opposite directions, the workpiece W held by the rotary carrier 1 and put between the two wheels is rotated on its own axis.

There are included bearing sections 46 and 47 for supporting the revolving gear case 32 on the gear box 34.

In the case where both the foregoing driving shaft 37 and 40 are driven under the state where the revolving gear case 32 rests temporarily, if the ratios of gears are individually identical to each other at the same time, the receiver wheel 10 and the pressure wheel 13 are only rotated in their rotational directions opposite to each other, adapting their rotational speeds to be the same. Therefore, the workpieces W pressed between the receiver wheel 10 and the pressure wheel 13 are only rotated, being not revolved. The revolving gear case 32 is given the rotational force, the direction of which is identical to that of the output shaft 33, so as to be driven in such a manner that there gives rise to a difference in speed between the rotation of the output shaft 33 and that of the input shaft 26, whereby the foregoing workpieces W are revolved in the same direction as that of the receiver wheel 10.

On the assumption that the number of rotations of the output shaft 33 in $n_1$, the number of rotations of the input shaft 26 is $n_2$, and the number of rotations of the revolving gear case 32 is $n_A$, and the following formula may be established:

$$n_1 = 2n_A - n_2$$

In that case, $n_1$ is proportional to the number of rotations of the receiver wheel 10 and $n_2$ is proportional to the number of rotations of the pressure wheel 13.

Figure 5:
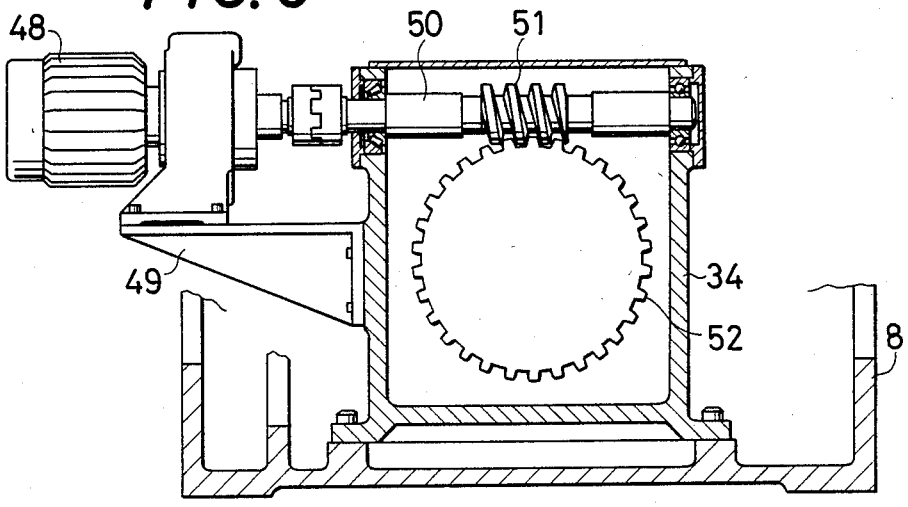
FIG. 5 is a side view taken on the line V—V of FIG. 5.
Figure 6:
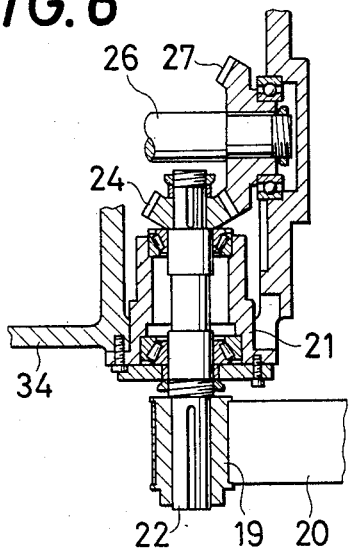
FIG. 6 is a plane view taken on the line VI—VI of FIG. 4.

In order to meet such a condition, as shown in FIG. 5, the motor 48 capable of being adjusted in its rotational speed is mounted on a bracket 49 firmly provided in the gear box 34, a worm gear 51 provided on the rotational shaft 50 of the motor 48 is adapted to be in mesh with the gear 52 concentrically fitted to the revolving gear case 32, and the rotational speed of the motor 48 is controlled, whereby the revolving gear case 32 is rotated at an adequate rotational speed so that the revolving speed of the workpiece W is controlled.

Figure 7:
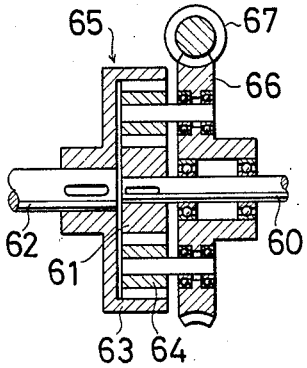
FIGS. 7 & 8 are longitudinal sectional views of other embodiments, respectively.

Referring now to FIG. 7, the case of using a planet gear mechanism 65 instead of the foregoing differential gear mechanism 25 is shown, wherein the sun gear 61 is mounted on the end of the input shaft 60, a crown gear 63 is mounted on the end of the output shaft 62, and the planet gear 64 is interposed between both the gears 61 and 63.

The planet gear 64 is pivotally mounted on the worm gear 66 rotatably supported by the input shaft 60 and adapts the worm 67 driven at the optional speed by the variable motor (not shown) to be in mesh with the worm gear 66.

Under the state where the worm gear 66 stops, the input shaft 60 is rotated so that the output shaft 62 is rotated in a reversible direction in accordance with the gear ratio between the gears 61 and 63 and, at that time, rotating the worm gear 66 will revolve the planet gear 64, whereby the rotational ratio between the input shaft 60 and the output shaft 62 can be optionally changed. The bevel gear 27 is mounted at one end of the input shaft 60, which is engaged with the gear 41 mounted on the driving shaft 40 of the pressure wheel 13. Also, at one end of the output shaft 62 is mounted the gear 35 thereof, which is engaged with the gear 36 of the driving wheel mounted on the driving shaft 37 of the receiver wheel 10. Thus, the same effects as those of the differential gear mechanism 25 already mentioned are obtained.

Figure 8:
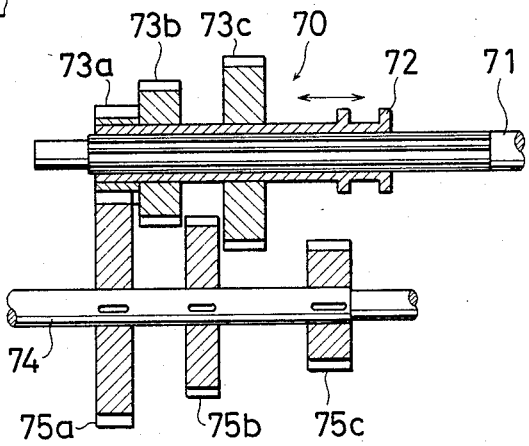

FIG. 8 illustrates the case of using speed change gears 70 as the variable driving means. A splined sleeve 72 is provided on the input shaft 71 and the sleeve 72 is equipped with a plurality of gears 73*a*, 73*b*, and 73*c* which are different in the number of teeth. A plurality of gears 75*a*, 75*b*, and 75*c* which are different in the number of teeth, being alternately in mesh with the foregoing gears, are mounted on the output shaft 74, and the sleeve 72 is axially moved by an operational mechanism (not shown), thereby optionally changing the ratio of the gears (the rotational ratio between the input shaft and the output shaft). The operation of the sleeve 72 may be performed whether automatically or manually. As with the planet gear mechanism 65, the bevel gear 27 is mounted at one end of the input shaft 71 and the gear 35 of the output shaft 62 is mounted at one end thereof so that drive may be transmitted to the driving shaft 40 of the pressure wheel 13 and the driving shaft 37 of the receiver wheel 10 respectively.

In that case, the ratio of the gears is step by step changed, and it is needless to say that the well-known stepless speed changing mechanism may be used in addition to the above arrangement.

Figure 1:
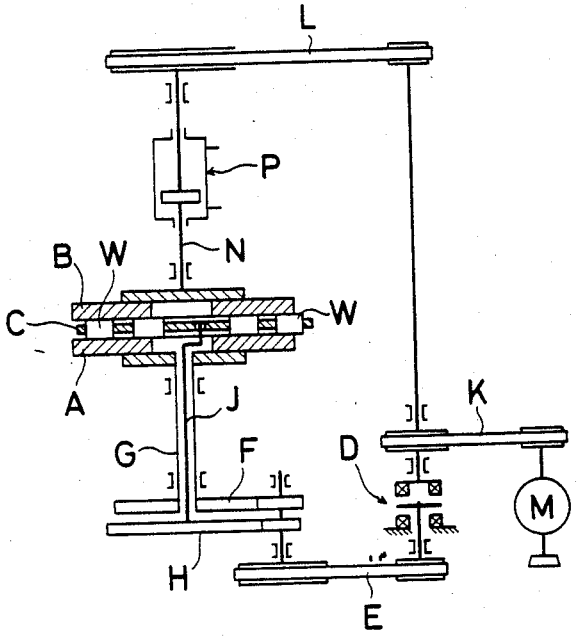
FIG. 1 PRIOR ART
FIG. 1 is a drawing illustratively exemplifying a transmitting system of the driving force for the conventional driving mechanism.

It will be apparent from the foregoing description that the present invention causes the fluid pressure supplied to the pressure cylinder 15 to exert the pressure force upon the workpiece W which are supplied into the pocket 2 of the rotary carrier 1 between the receiver wheel 10 and the pressure wheel 13, and drives both these wheels 10 and 13 to be rotated in their directions opposite to each other, while adjusting their rotational speeds at the same time, thereby rotating and revolving the workpieces W. Such mechanism presses the end face of the workpiece W against the grindstone 6 arranged on the periphery thereof by the centrifugal force of the workpiece W so as to grind said end surface to be shaped into the spherical surface. At that time if the revolving speed of the workpiece W is properly controlled, it is possible to adjust adequately the number of rotations of the workpiece per the length of the grindstone. For this reason, the best working conditions subject to the shape, size, and material of the end face of the workpiece can be established and such an unstable process ascribed to the change in the grinding resistance and the difference in efficiency between the motors as taking place in the conventional process using two general-purpose motors is reduced, the fine adjustment thereof being possible. As compared with the conventional equipment of FIG. 1, the fine adjustment as to the rotation and revolution of the workpiece is freely executed, with its operation being remarkably facilitated.

The driving shafts of the receiver wheel and the pressure wheel may of course be replaced to be interlocked with the input and output shafts of the variable driving means such as the differential gear mechanism and others and the installation place of the differential gear mechanism is also not limited to the illustrated example.

What is claimed is:

1. A vertical spindle duplex head for a grinder for grinding the end face of a workpiece to be rolld while rotating and revolving the workpiece, comprising a receiver wheel of an annular shape, a pressure wheel disposed above the receiver wheel, a pressing means for advancing and retreating the pressure wheel toward and from the receiver wheel, a rotary carrier for holding in a peripheral groove the workpiece to be put between the receiver wheel and the pressure wheel, an annular grindstone firmly held by a holding means concentrically with the rotary carrier, and a driving means for driving the receiver wheel and the pressure wheel to be rotated in opposite directions, characterized by:

a distributive transmittance mechanism comprising a first driving shaft, a bearing housing of the frame supporting the first driving shaft, a first bevel gear fixed to a lower end of the driving shaft, a second shaft driven by a reduction gear through pulleys and a timing belt, a frame supporting said second shaft, a gear box formed integrally with the frame supporting the second shaft, a second bevel gear mounted on the second shaft, a third bevel gear engaging the first bevel gear and the second bevel gear at the same time, and a cover of the gear box rotatably supporting the third bevel gear;

a differential gear mechanism comprising an input shaft with the third bevel gear mounted at an end thereof, a receiver wheel driving shaft supported by a bearing housing of the frame, a first gear of the receiver wheel driving shaft mounted at the lower end thereof, a second gear of an output shaft engaging the last mentioned first gear, said output shaft having the last mentioned second gear mounted at an end thereof, sun gears mounted opposite each other at the ends of the input shaft and the output shaft respectively, a pair of planet gears opposite each other engaging the sun gears, a planet gear shaft rotatably supporting the planet gears, a revolving gear case rotatably supporting the planet gear shaft and rotatably supported by the input shaft and the output shaft, and said gear box forming a bearing housing for the revolving gear case; and a variable-speed driving means comprising a worm gear mounted on the revolving gear case concentrically with the output shaft, a second worm gear engaging the first mentioned worm gear and supported by the frame, and a variable-speed motor for driving the second worm gear.

* * * * *